US007069862B2

(12) United States Patent
Bassett

(10) Patent No.: US 7,069,862 B2
(45) Date of Patent: Jul. 4, 2006

(54) HANDHELD TOOL FOR BREAKING UP ROCK

(76) Inventor: Carroll Bassett, HC68 Box 64B, Friars Hill, WV (US) 24938

( * ) Notice: Subject to any disclaimer, the term of this patent is extended or adjusted under 35 U.S.C. 154(b) by 15 days.

(21) Appl. No.: 10/521,083

(22) PCT Filed: Jul. 29, 2003

(86) PCT No.: PCT/US03/23615

§ 371 (c)(1),
(2), (4) Date: Jan. 12, 2005

(87) PCT Pub. No.: WO2004/012912

PCT Pub. Date: Feb. 12, 2004

(65) Prior Publication Data

US 2005/0257675 A1 Nov. 24, 2005

Related U.S. Application Data

(60) Provisional application No. 60/400,502, filed on Aug. 5, 2002.

(51) Int. Cl.
*F42B 3/10* (2006.01)

(52) U.S. Cl. ..... 102/319; 102/322; 299/13; 42/108; 86/20.15

(58) Field of Classification Search ..... 102/319, 102/322, 304; 299/13, 16; 42/108; 86/20.15
See application file for complete search history.

(56) References Cited

U.S. PATENT DOCUMENTS 1,503,420 A * 7/1924 Hutton ..... 102/304
1,585,664 A 5/1926 Gilman
2,058,099 A 10/1936 Osgood
2,257,270 A 9/1941 McCullough
2,296,504 A 9/1942 Crater
2,587,243 A 2/1952 Sweetman
3,208,381 A 9/1965 Kihlstrom et al.
3,721,471 A 3/1973 Bergmann et al.
4,037,537 A * 7/1977 Thorsell et al. ..... 102/272
4,306,628 A 12/1981 Adams, Jr. et al.
4,508,035 A 4/1985 Mashimo et al.
4,669,783 A 6/1987 Kolle
4,900,092 A 2/1990 Van Der Westhuizen et al.
5,060,573 A * 10/1991 Montgomery et al. ... 102/202.5
5,069,130 A 12/1991 Buckley et al.
5,098,163 A 3/1992 Young, III
5,308,149 A 5/1994 Watson et al.
5,474,364 A 12/1995 Ruzzi et al.

(Continued)

*Primary Examiner*—Stephen M. Johnson
(74) *Attorney, Agent, or Firm*—Johnston Holroyd; Mary-Jacq Holroyd

(57) ABSTRACT

A tool (12) has a body (14) with a barrel (18) having opposing threaded and fitted openings (30 and 28). An actuator pin tube (26), for slidably engaging an actuator pin (38) having a tip (40) opposing a retention head (42), extending from the fitted opening (30). A spring assembly (24), disposed in the barrel (18), has a hammer guide (44) engaged in the threaded opening (28) with a hammer (46) slidably engaged therein, a handle mechanism (55) disposed at one end and a spring retainer (52) disposed adjacent the other end of the hammer (46) before a hammerhead (51), and a spring (54) engaged between the hammer guide (44) and the spring retainer (52). A release mechanism (56) engages the hammer (46). A kit (108) containing the tool (12) and a method of operating the tool (12) involving drilling and cleaning a borehole, inserting a cartridge and tool therein, and detonating the load remotely using a pull cord.

20 Claims, 5 Drawing Sheets

U.S. PATENT DOCUMENTS

| | | | |
|---|---|---|---|
| 5,573,307 | A | 11/1996 | Wilkinson et al. |
| 5,611,605 | A | 3/1997 | McCarthy |
| 5,705,768 | A | 1/1998 | Ey |
| 5,765,923 | A | 6/1998 | Watson et al. |
| 5,789,694 | A | 8/1998 | Mey |
| 5,803,550 | A | 9/1998 | Watson et al. |
| 5,803,551 | A | 9/1998 | McCarthy |
| 5,900,578 | A | 5/1999 | Wathen |
| 6,145,933 | A | 11/2000 | Watson et al. |
| 6,148,730 | A | 11/2000 | Watson |
| 6,318,272 | B1 | 11/2001 | Mey |
| 6,339,992 | B1 | 1/2002 | Watson |
| 6,375,271 | B1 | 4/2002 | Young, III |

* cited by examiner

HANDHELD TOOL FOR BREAKING UP ROCK

RELATED APPLICATIONS

This application claims the benefit of U.S. Provisional Application Ser. No. 60/400,502 filed on 5 Aug. 2002, the contents of which are incorporated herein by reference in its entirety.

FIELD OF THE INVENTION

The present invention relates to a tool and a method for breaking up rock, and in particular, to a handheld remote detonation tool, a kit containing the tool, and a method for breaking rock, masonry and the like using the tool and kit.

BACKGROUND OF THE INVENTION

Numerous devices have been utilized in the art of breaking up rock. Most such devices are quite large, and are used in mining, quarries and excavation endeavors. These devices and methods are typically for large-scale efforts resulting in massive explosions, and the destruction or generation of large areas of rock. Few devices exist for specialized small scale breaking efforts; however, these devices tend to be larger than the present device and utilize far more explosive forces.

For example, U.S. Pat. No. 5,789,694 ('694) shows a tool and method for breaking up rock. The tool of '694 has a barrel, a breech body for receiving a gas discharge cartridge loaded with gas producing propellant and a firing-handle mechanism (a firing pin) for firing the cartridge. The method involves drilling a hole in rock, filling the hole with water, passing the barrel down the hole, and firing the cartridge. The cartridge used is similar to a shotgun cartridge and has a rim-fire percussion cap, which complements the firing pin. The device of '694 further utilizes a trigger assembly attached to a lanyard for remote triggering of the firing pin. In operation, the barrel is inserted into a water-filled hole while the cartridge, which is engaged at the top of the barrel opposite the bottom of the hole, is detonated by the firing pin thereby producing rapid gas expansion into the water generating shock waves throughout the water and fracturing of the rock. The triggering device is cocked before use, and the lanyard is pulled to fire the device from a remote location. The device additionally uses a blast shield.

The explosive gas cartridge of the '694 invention is placed in the middle of the device at the top of the barrel. The barrel of the '694 patent is used as a pipe for channeling the force of the detonated gas chamber into the bottom of the borehole. The device of '694 requires a blast shield indicating the great force released thereby. A smaller device, which has a smaller explosion, is desired so that the device may be used in circumstances not conducive to most explosions.

Many related art devices involve methods that require drilling boreholes and generating a rapid increase in the concentration of pressure in the bottom of a borehole either by explosions, or a sudden increase in fluid pressure, to facilitate and propagate fracturing of the rock. Many of these inventions are designed to excavate rocks or dig tunnels, and include various boom-supported devices. All of these devices use impact and expansive gas in order to break apart rock or other hard material. These devices are quite large and produce substantial explosions/gas expansions, and are otherwise unsuitable for the purposes of the present invention.

The majority of the related art uses large-scale devices, which are disposed on boom arms.

Methods of breaking up rock which couple explosive (or rapid gas expansion) and mechanical impact breaking to excavate rock and dig tunnels are well known. U.S. Pat. No. 5,803,550 ('550) discloses a method for breaking rock using small-charge blasting techniques followed by a mechanical impact breaker. In the small-charge blasting technique, a gas is released into the bottom of a sealed hole. The gas pressure rises rapidly in the hole until the gas pressure causes the hard material to fracture followed by an impact breaker to complete the fracturing of the rock and to remove the fractured material. The '550 device involves a large mobile undercarrier having a boom assembly with a mechanical impact breaker and a small charge blasting apparatus attached thereto. It is desirable to have a very small charge blasting technique that is effective without using an impact breaker to increase the fracture of the rock generated by the detonation of the load.

Similarly, U.S. Pat. No. 5,308,149 ('149) uses a controlled-fracturing process accompanied by pressurizing the bottom of a drill hole in such a way as to initiate and propagate a controlled fracture. The process of '149 uses a large apparatus to operate.

U.S. Pat. No. 6,145,933 ('933) describes a method for removing hard rock by a combination of impact hammers and small charge blasting. The method of '933 uses small-charged blasting techniques followed by a mechanical impact breaker. In the small-charge blasting technique of the '933 patent, a gas is released into the bottom of a sealed hole located at a free surface of the rock. The gas pressure rises rapidly in the hole until the gas pressure causes the rock to fracture. A blasting agent may be used to cause initial subsurface fractures. An impact breaker is then used to complete fracturing and removal of the material. The devices utilized in the invention of '933 are large scale and are held into position by boom arms.

It is known in the art to seal or block the bore hole to increase the pressure at the bottom of the hole without using additional impact apparatuses. U.S. Pat. No. 6,148,730 describes a method and apparatus for controlled small-charge blasting by pressurization of the bottom of a drill hole. The invention therein involves drilling a hole in rock, inserting a cartridge containing an explosive apparatus, bracing the cartridge with a massive stemming bar in the drilled hole, and detonating the explosive thereby generating fractures in the rock. Likewise, U.S. Pat. No. 6,035,784 discloses a method and apparatus for controlled small-charge blasting of hard rock explosive pressurization of the bottom of a drill hole which uses a cartridge containing an explosive charge inserted into the bottom of a drilled hole wherein the cartridge is held in place by a massive stemming bar. The stemming bar also serves to partially block the hole increasing the pressure of the explosion.

U.S. Pat. No. 5,765,923 teaches a cartridge for generating high-pressure gases in a drilled hole. The cartridge includes a base member, a body member, a propellant, and a device for sealing a surface of the cartridge to the surface of a hole in the material. Upon ignition of the propellant, gas pressure rapidly rises in the hole due to the sealing device. The gas pressure causes the material to form a penetrating cone fracture. The cartridge is placed in a hole by a boom suspended from large-scale equipment. In operation, the cartridge is first loaded into a combustion chamber and a gas injector barrel is placed into the drill hole. A firing pin is actuated thereby triggering the primer, which in turn ignites the igniter power, which in turn ignites the propellant. As the propellant burns, pressure is built up within the cartridge. At a desired psi (pounds per square inch), the cartridge body ruptures releasing the generated gas into the combustion chamber and the barrel.

Many related art devices and methods involve apparatuses that insert explosives into a hole using a boom, which explosives may then be detonated remotely. Additionally, the boom arm may serve to partially seal the hole. U.S. Pat. No. 3,721,471 shows a drill-and-blast module which is disposed on the end of a boom for insertion in a hole and detonation thereof. U.S. Pat. No. 5,098,163 ('163) discloses a controlled fracture method for breaking hard compact rock which involves a boom supported apparatus that inserts an explosive, or a propellant charge, in a pre-drilled hole. The '163 apparatus may utilize a barrel to insert the explosives, and the hole may be sealed behind the explosive in an effort to control the explosion.

Furthermore, it is well known to use devices and methods, which increase fluid pressure by means other than explosive or rapid gas expansion, to break apart the rock. U.S. Pat. No. 4,669,783 teaches a process and apparatus for fragmenting rock using an explosion-free pulse of water directed into a borehole resulting in high-pressure shock waves that fractures the rock. U.S. Pat. No. 6,375,271 describes a controlled foam injection system for fragmentation of hard compact rock whereby a high pressure foam is inserted into a drill hole by a barrel, which seals the hole and is disposed at the end of a boom attached to heavy equipment.

Alternative detonation techniques and hybrid methodologies are also known. U.S. Pat. No. 2,058,099 describes a blasting cartridge that is inserted into a drill hole. High water pressure is exerted on the cartridge through a pipe resulting in a sudden explosive release of pressure increasing substance from the cartridge. U.S. Pat. No. 5,803,551 ('551) discloses a method, apparatus and cartridge, which are disposed on a boom truck, for non-explosive rock fragmentation. The '551 method involves first drilling a hole into a rock, positioning a charging system having a propellant cartridge inserted therein, which cartridge has a propellant and means for igniting the propellant, and forcing the propellant cartridge through the charging system and into the hole to ignite the propellant.

U.S. Pat. No. 6,318,272 teaches a method of breaking rock, which includes drilling a hole in the rock by a drilling machine having an articulated boom and a drilling tool at the end of the boom. After removing the drilling tool, a rock breaking charge is charged into the hole, which charge includes a propellant, a fuse head, and a tamping medium contained in a casing. The tamping medium is discharged into the hole and allowed to set around and rearward of the propellant. The driving mechanism is removed and the propellant is actuated from a remote position via electrical charge or the like.

U.S. Pat. No. 4,508,035 involves an explosive charging apparatus for rock drilling which charges a controlled amount of explosives sequentially to bores drilled in a rock surface and includes an explosive charging pipe, a boom mechanism carrying the explosive charging pipe, boom actuators, a control circuit and an explosive charging pipe. U.S. Pat. No. 5,611,605 describes a method, apparatus and cartridge for non-explosive rock fragmentation which involves drilling a hole into a rock, and inserting a propellant cartridge into a charging housing with a means for igniting the propellant, and forcing the propellant cartridge through a charging hose and into the hole to ignite the propellant. The apparatus and cartridge of '605 are inserted using a boom device.

It is known to use pressurized fluids in a hole to break rocks. U.S. Pat. No. 6,339,992 ('992) shows a small charge blasting apparatus including an apparatus for sealing pressurized fluids in holes. The invention therein provides a relief volume for a pressurized working fluid in the bore of a barrel that is inserted into a hole in the material to be broken. The invention seals the fluid into the hole while a gas-generator generates greater pressure. The requirement of a separate apparatus for sealing pressurized fluids into bore holes is inconvenient especially in any emergency rescue operations where the least amount of equipment, especially bulky equipment, in most desirable.

Numerous diverse methods and apparatuses have been developed to aid in breaking rock and other hard surfaces. U.S. Pat. No. 5,573,307 ('307) describes a method and apparatus for blasting hard rock using a highly insensitive energetic material ignited with a moderately high-energy electrical discharge causing the fracturing and break up of hard rock. The blasting apparatus of '307 has a reusable blasting probe which includes a high voltage electrode and a ground return electrode separated by an insulating tube. The two electrodes of the blasting probe are in electrical contact with a metal powder and oxidizer mixture that will generate an exothermic reaction upon generation of an electric current therebetween creating a gas expansion to fracture the rock.

U.S. Pat. No. 2,587,243 ('243) describes a cutting apparatus, which produces a very high velocity gaseous penetrating jet for cutting materials or objects using a chemical charge. No borehole is drilled prior to the use of the '243 apparatus. U.S. Pat. No. 3,208,381 shows a device for loading bore holes with explosives in bar-shaped or tubular packages, which device is a generally tubular sleeve constructed of resilient material to receive one end of an explosive package.

A variety of cartridges are used in the related art. Cone-shaped blasting cartridges or plugs are designed to contain or control the explosion in a drilled/bore hole. U.S. Pat. No. 5,705,768 shows a shaped charge to be placed into a bore hole, which shaped charge includes an elongate housing having a concave recess in an upper end, an explosive located within the housing and below the recess, and a detonator positioned beneath the recess and explosive.

Similarly, U.S. Pat. No. 2,296,504 ('504) teaches a blasting plug designed to control the level of explosion resulting from the detonation of dynamite, and prevent an uncontrolled explosion and resultant fire hazard. The method of using the device of '504 involves inserting the device in a borehole and detonating the device remotely. U.S. Pat. No. 5,900,578 describes a method of breaking slabs that involves drilling bore holes along a desired break line, inserting a detonating cord therein, filling the bore holes with a shock transmitting/moderating composition, and detonating the detonation cord.

U.S. Pat. No. 1,585,664 ('664) shows a method and apparatus for breaking rock which utilizes projectiles (similar to bullets) and a forcible ejection means attached to a boom. The projectiles are fired at the surface of the rock. The '664 invention demonstrates that the use of bullet-like explosives is known in the art. U.S. Pat. No. 5,069,130 describes a propellant igniter. U.S. Pat. No. 4,900,092 discloses a barrel for a rock breaking tool and method for breaking rock which involves drilling a hole in rock, filling the hole with water, inserting a short barrel of a rock breaking tool into the hole entrance, covering the tool with a recoil restraining mat, and discharging a cartridge down the barrel.

None of the above inventions and patents, taken either singularly or in combination, is seen to describe the instant invention as claimed. Specifically, these devices lack the simplicity and portability desired for truly small-scale rock breaking, and especially, for rock breaking that must not generate an explosion of any significant force.

SUMMARY OF THE INVENTION

The present invention relates to a tool designed for the small scale cracking and demolition of solid materials, including but not limited to rock and masonry. In particular the present invention relates to a remote detonation tool that is used in splitting off part of a rock or other hard material. The term "rock" when used herein shall include any suitable hard material, such as concrete. The present invention further contemplates a kit incorporating the rock-breaking tool, and a method of using the tool and kit to break rock by creating a small explosion in the bottom of a hole drilled in the rock. This type of drill hole is frequently referred to as a borehole. Presently, the kit contains the tool, a rubber bulb hole blower, a release cord with clip (25 ft. long), two tapered drift pins, a hex key (⅛ inch) and an instruction manual. The kit may further contain a brush for cleaning the borehole and cartridges.

The tool has a barrel formed in a body having a spring assembly inside the barrel. The spring assembly consists of a hammer with a handle mechanism for manually cocking the hammer, such as a split ring-handle, engaged on one end of the hammer, a hammerhead at the second end opposite the handle mechanism, and a spring engaged between the two ends. The hammer further has a channel for mating with a release plate in a hold position. The hammer engages a guide disposed inside the barrel of the tool. An actuator pin tube is attached to the barrel opposite the handle mechanism and an actuator pin is engaged in an opening through the actuator pin tube. The hammerhead engages the head of an actuator pin when the spring is most relaxed thereby forcing the actuator pin downward with the tip of the actuator pin sticking out of the bottom end of the actuator pin tube opposite the pin head. A release mechanism, which may be a release plate, is provided for releasably engaging the hammer. The release plate is disposed at one end of the body opposite the actuator pin tube and has an elongated opening which mates with the end of the hammer adjacent the handle mechanism, and also serves to prevent the hammer from becoming displaced inside the barrel. The release plate has two positions with the elongated opening configured to hold and release the hammer. The two different positions of the elongated opening correspond to hold and release positions.

The hammer is cocked by pulling the hammer by the handle mechanism thereby putting force on the spring, and then pushing the release plate so that the elongate opening slides into the hold position relative to the channel in the hammer. The actuator pin is actuated by pulling a cord attached to the release plate so that the channel moves into the release position thereby releasing the hammer resulting in the actuator pin forcefully pushing outward through the tube.

The method of breaking rock contemplated by the present invention partially comprises drilling a borehole six to nine inches deep and four to twelve inches from the edge of the rock, depending on the material to be cracked. A load, in the form of a low energy propellant cartridge, is placed within the cleaned borehole. The actuator pin tube is inserted into the borehole so that the end of the actuator pin tube makes contact with a primer disposed at one end of the cartridge while the body of the tool remains adjacent the surface of the rock. An indicator on the head of the actuator pin can be seen through a sight hole preferably provided in the body of the tool thereby assuring proper relative placement of the tool and cartridge. The load is detonated by the mechanical action of the actuator pin striking the primer when the release cord is pulled. No additional damper mechanism or sealing of the borehole is required as the tight fit of the activator pin tube in the borehole, coupled with the inertia of the body mass, tend to keep the tool in place during the brief period of detonation.

The present invention may be used by a large variety of potential users including excavators, blasting contractors, farmers, geologists, park trail builders, demolition contractors, prospectors, mining operations, road departments, landscapers, quarry operations, tactical personnel including police and armed services, structure collapse rescue teams, cave rescue and exploration groups. Equipment rental centers may also have use for such devices.

An aspect of the present invention is that the tool and method require very small diameter boreholes, typically about 0.375 inches or smaller, which can be more easily drilled by cheaper and more readily available consumer level equipment. Other methods of cracking hard material require the drilling of relatively large holes, generally an inch in diameter or larger. Alternatively, other methods require strenuous and often dangerous manual labor. The drilling equipment used to accomplish the other methods is expensive and generally requires high skill levels to operate.

Another aspect of the present invention is that the tool and method generate a relatively low energy output. This low energy output allows operators to use the tool and method in environments sensitive to the use of higher energy methods and devices.

Yet another aspect of the present invention is the portability of the tool. Since the device is quite small, it can be transported almost anywhere. An example of the usefulness of the small configuration of the tool is the potential use miles underground to open passages in caves for rescue or exploration. The tool easily fits into a hand held carry case with all the essential equipment needed to operate the tool.

A further aspect gained by the small size and relative simplicity of the system is its projected low cost to own and operate. This coupled with the elimination of large borehole drilling devices will allow many more people to successfully and economically deal with demolition problems in a far easier manner than has previously been available.

Since the tool's uses are not typically governed by blasting regulations and license requirements in most areas, the tool saves the users money by eliminating the expenses and logistics of hiring separate highly trained and licensed personnel. The tool also eliminates the risks of collateral damage to nearby property, which is always a concern when using high explosives. Many municipalities now have outright bans on the use of high power explosives within their jurisdictions which forces contractors to use track loader mounted hydraulic demolition hammers, pneumatic jack hammers, or expensive and slow acting hydraulic cements to crack materials. All of these methods can cost many times as much as using the present invention and can severely delay projects when unexpected obstacles are encountered.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1A:
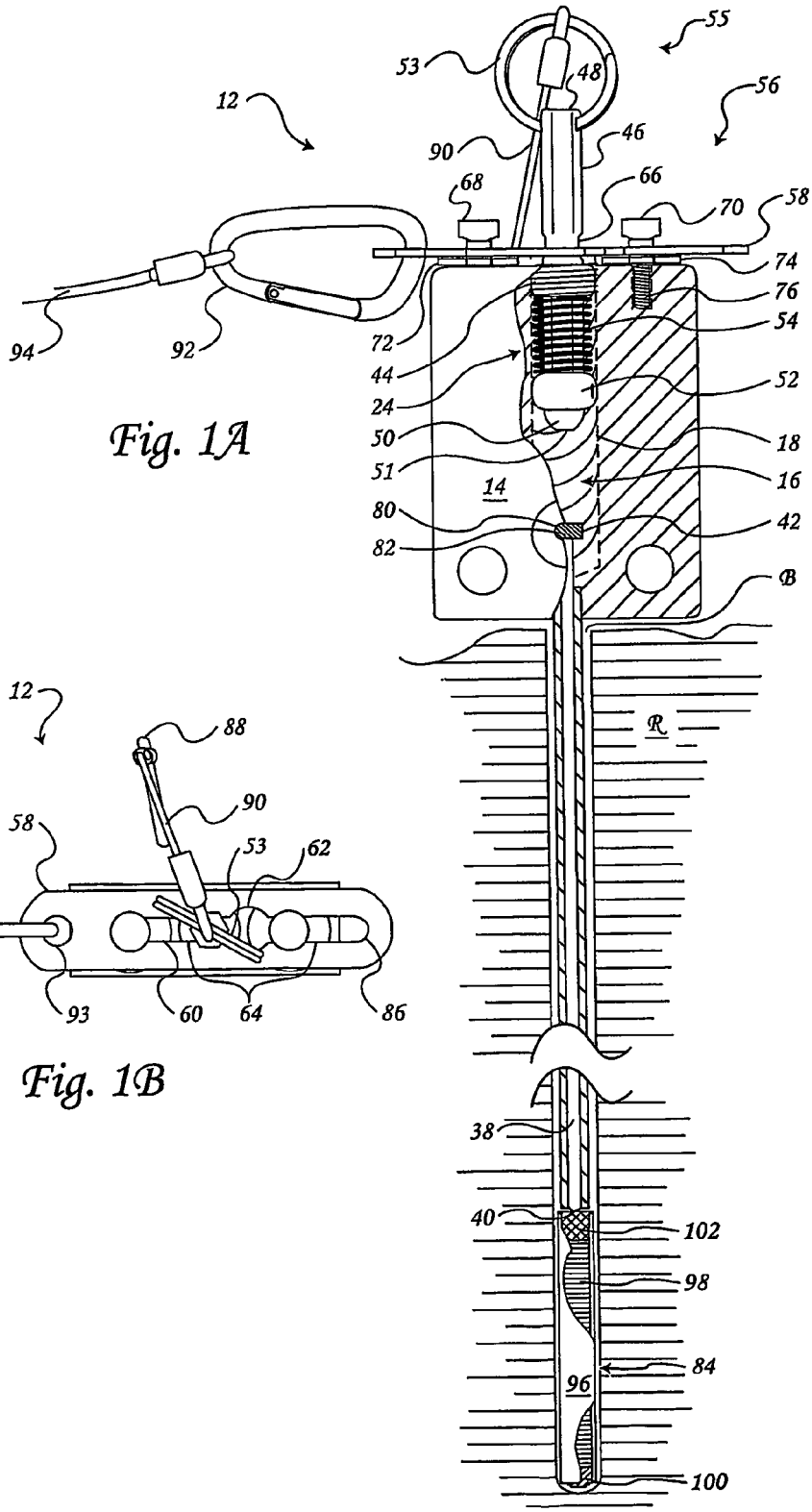
FIG. 1A is a sectional side view of the tool of the present invention engaged in a cutaway view of a borehole in a rock showing the arrangement of the tool armed without a safety engaged and with the actuator pin of the tool in contact with a cartridge engaged in the cutaway borehole.

The present invention relates to a handheld tool (12), as shown in FIGS. 1A through 4, and method for the small scale cracking and demolition of solid materials, including but not limited to rock and masonry. FIGS. 1A and 1B show the tool (12) of the present invention cocked, in a hold position, and ready to use. FIG. 1A further depicts the tool as used by showing a cutaway of a borehole (B) in a rock (R) having the tool (12) engaged and a cartridge (84) in the proper position in the borehole (B). FIGS. 2A and 2B show the tool (12) uncocked or in a release position. The tool (12) of FIG. 2A is shown relative to an average human hand (H) demonstrating the size of a preferred embodiment of the tool (12) of the present invention. FIGS. 3A and 3B show the tool in the hold position, cocked, with a safety mechanism (89) engaged to prevent premature release.

Figure 4:
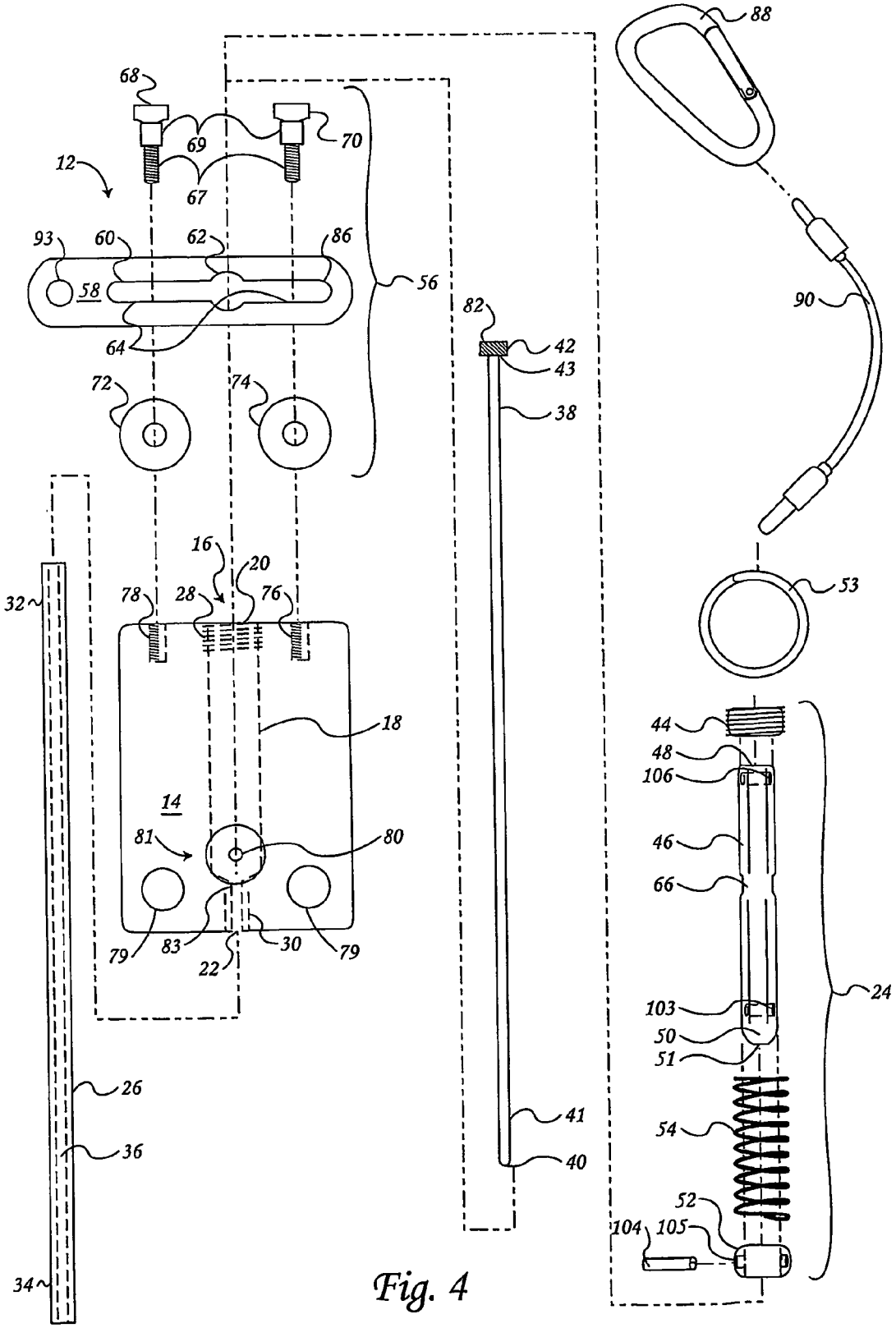
FIG. 4 is an exploded view of the tool of the present invention.

The tool (12) for breaking hard material (R), according to the present invention, has a body (14) with an opening (16) therethrough forming a barrel (18), which can be seen most clearly in the exploded view of the tool (12) depicted in FIG. 4. The barrel (18) has an opening (28), preferably a threaded opening, at its first end (20) and a fitted opening (30) at its second end (22). A spring assembly (24) is received through the first end (20) of the barrel (18) and held in place, as shown in the drawings and discussed hereinafter. An actuator pin tube (26), having a complementary shape to that of the fitted opening, is received in the fitted opening (30) of the second end (22) of the barrel (18).

In a preferred embodiment of the present invention, the body (14) may be comprised of carbon steel and have external dimensions of 3¼ inches by 2½ inches by 1 inch thick. The barrel (18) may be a 9/16-inch hole with the threaded opening (28) extending ⅜ inch into the barrel (18) wherein the entire barrel goes down 2⅝ inches to the fitted opening (30) with the fitted opening (30) extending therebelow with a pinched region (83) inbetween, as discussed hereinafter, the pinched region (83) may be tapered from the wider portion of the barrel (18). The actuator pin tube (26), which may be composed of a hardened tool steel, may have an external diameter of 5/16 inch and an internal diameter of ⅛ inch, and a length of 8½ inches with 8 inches exposed. The actuator pin (38) may be 8⅞ inches long with a ⅛ inch diameter.

The actuator pin tube (26) has a first end (32) and a second end (34). The first end (32) of the actuator pin tube (26) is engaged securely in the fitted opening (30) of the barrel (18) in the body (14) of the tool (12). The fitted opening (30) and the first end (32) of the actuator pin tube (26) have complementary shapes designed to secure a tight fit therebetween. The second end (34) of the actuator pin tube (26) extends outward from the fitted opening (30). The actuator pin tube (26) has an opening (36) therethrough for slidably engaging an actuator pin (38), as shown in the drawings. The actuator pin (38) has a tip (40) and a retention head (42) at opposing ends (41 and 43). The tip (40) may be tapered and rounded. The retention head (42) serves to retain the actuator pin (38) in the actuator pin tube (26) by preventing the actuator pin (38) from sliding therethrough. The actuator pin (38) fits into the actuator pin tube (26) and is long enough so that the tip (40) extends through the second end (34) of the actuator pin tube (26). In a preferred embodiment, the retention head (42) may have a diameter of ¼ inch and be an ⅛-inch long.

A hammer guide (44) is engaged in the opening (16), as shown, with the spring assembly (24) engaged in the hammer guide (44). The spring assembly (24) comprises a hammer (46), a spring (54), a hammerhead (50), a spring retainer (52), and a handle mechanism (55) for manually cocking the hammer (46), such as a split ring-handle (53). A cable (90) may be attached to the ring-handle (53) or equivalent handle mechanism (55). The present invention is seen to incorporate any equivalent handle mechanism (55), and is not limited to the split ring-handle (53) arrangement shown in the figures. The cable (90) may be a wire rope cable, and may be 4 inches long with a diameter of 1/16-inch steel cable.

Figure 2A:
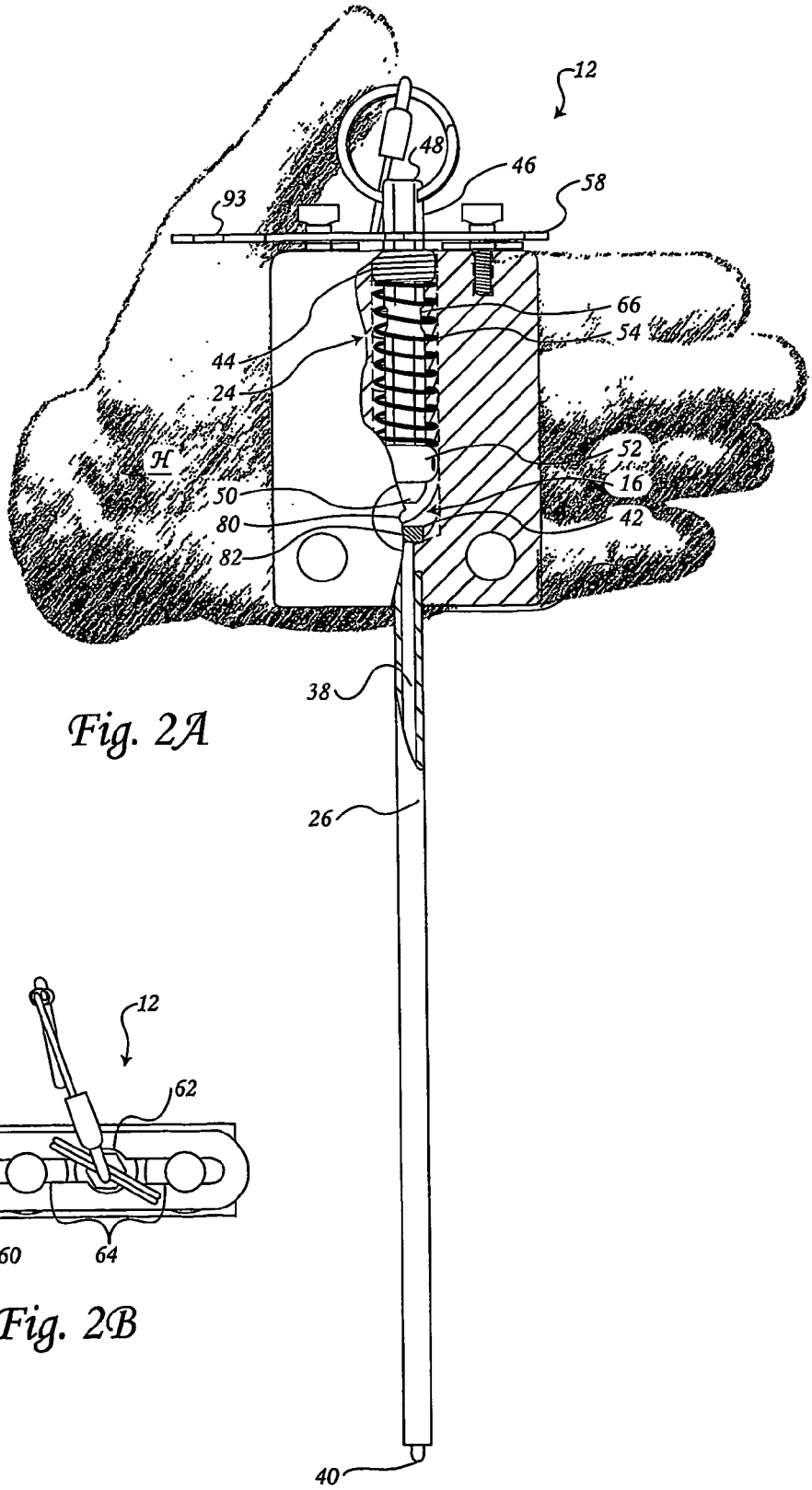
FIG. 2A is an environmental sectional side view of a tool according to the present invention in a discharge position.
Figure 2B:
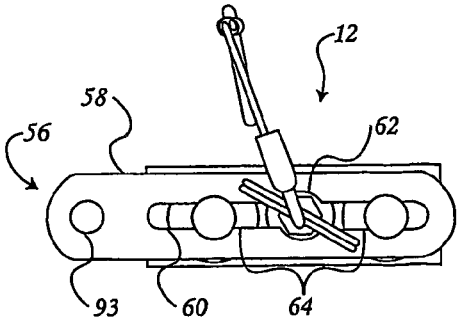
FIG. 2B is a top view of the tool of FIG. 2A wherein the tool is in a discharged position.

The hammer (46) is slidably engaged through the hammer guide (44), the hammer (46) having a first end (48) and a second end (50). A handle mechanism (55) is disposed on the first end (48) of the hammer (46) and a spring retainer (52) is disposed adjacent the second end (50) of the hammer (46). A hammerhead (51) is formed at the second end (50) of the hammer (46). The ring-handle (53) may be disposed on the hammer (46) through an opening (106) in the first end (48) thereof. A spring (54) is engaged on the hammer (46) between the spring retainer (52) and the hammer guide (44) such that the spring (54) places tension outward on the spring retainer (52). FIG. 1A shows the spring contracted, and FIG. 2A shows the spring in its most relaxed position. Tension remains on the spring retainer (52) while it is in the contracted or cocked position. In the relaxed position, tension is not placed on the spring retainer (52). The spring retainer (52) may be a bushing, as shown, held fixed in place, relative to the hammerhead (51) at the second end (50) of the hammer (46), by a roll pin (104). Furthermore, where the handle mechanism (55) is a ring-handle (53), an opening (106) may be disposed in the hammer (46) for receiving the ring-handle (53) therethrough. The ring-handle (53), or other handle mechanism, also prevents the hammer (46) from becoming dislodged through the hammer guide (44) when the spring assembly (24) is removed from the body.

A release mechanism (56) for releasably engaging the hammer (46) may be provided in the form of a release plate (58). The hammerhead (50) contacts the retention head (42) when the spring (54) is fully relaxed, in order to put force through the tip (40) and onto a properly placed cartridge (84) thereby detonating it. The invention further provides a sighting mechanism (81) for determining position of the actuator pin (38) and a safety mechanism (89) to prevent premature detonation of the cartridge (84). The release plate (58) has two positions with the elongated opening (60) configured to alternatively hold and release the hammer (46), as shown most clearly in FIGS. 1B and 2B.

The release mechanism (56) may be a release plate (58) slidably engaged on the body (14) wherein the hammer (46) is slidably engaged in an elongated opening (60) of the release plate (58). The elongated opening (60) has a wide portion (62) and a narrow portion (64), and the hammer (46) has a retention groove (66) disposed between the first and second ends (48 and 50) of the hammer (46) such that the hammer (46) can freely slide when the wide portion (62) is engaged on the hammer (46), see FIG. 2B, but is retained in position when the retention groove (66) is engaged in the narrow portion (64) of the elongated opening (60), see FIG. 1B. Furthermore, the release plate (58) may be slidably engaged on first and second release plate screws (68 and 70). Each release plate screw (68 or 70) has a threaded part (67) and a smooth shoulder (69).

In a preferred embodiment, the threaded (67) part to the shoulder (69) may be ⅜ inch long and may be a number 12 bolt thread with 24 threads per inch. The shoulder (69) may be ¼ inch diameter and a ¼ inch long. Regardless of the dimensions of the tool (12), the shoulder (69) must be as long as the release plate (58) is thick to facilitate the sliding of release plate (48) along the shoulder of the release plate screws (68 and 70). Furthermore, in a preferred embodiment, the release plate screws (68 and 70) accommodate a ⅛-inch hex wrench (114), see details of kit (108) below, to allow disassembly of the tool (12). The hammer (46) may consist of a 5⁄16-inch hex shaft wherein the retention groove (66) is 3⁄16-inch wide and is lathed to a ¼ round diameter and starts 1⅛ inches from the end opposite the hammerhead (50). The hex shaft is beveled at the end to form a ¼ inch round hammerhead (50) that is beveled back 3⁄16 inch and has an ⅛ inch opening (103) drilled therethrough to accommodate a ⅛ inch roll pin (104). The opening (106) for the split ring-handle (53) may be a ⅛-inch diameter and drilled 1⁄16-inch from the end opposite the hammerhead (50). The hammer guide (44) may be a standard ⅝-18 hex jam nut. The spring (54) may have 10 coils wherein each coil is 1⁄16-inch diameter. The spring (54) is 1½ inches long when uncompressed. The spring retainer (52) may consist of a brass bushing having a ⅜-inch inside diameter opening to accommodate the hammer (46) adjacent the hammerhead (51), and an outside diameter of 37⁄64 inches. The spring retainer (52) may have an opening (105) drilled therethrough perpendicular to the hammer (46) once engaged, as shown in FIG. 4, to accommodate the roll pin (104).

The release plate screws (68 and 70) and the body (14) may be further separated by first and second friction reducing washers (72 and 74), as shown in the figures. In a preferred embodiment, the first and second friction reducing washers (72 and 74) may be ¼-inch inside diameter nylon washers with an external diameter of ¾-inch with a thickness of 1⁄16-inch. The release plate screws (68 and 70) are fixedly engaged in openings (76 and 78) of the tool body (14) wherein the openings (76 and 78) are flanking the threaded opening (28) of the barrel (18). A release cord (94) is attached to a release hole (93) disposed in the release plate (58), as shown. The release plate (58) may be roughly a 3⁄16 thick, 3½ inches long, and ¾-inch wide. The elongated opening (60) may be 2⅜ inches long and 9⁄32-inch wide at the narrow portion (64), and ⅜-inch wide at the wide portion (62). The openings (76 and 78) may be threaded with a number 12 tap having 24 threads per inch.

In operation, the hammer (46) is cocked by pulling the hammer (46) by the handle mechanism (55) thereby putting force on the spring (54), and then pushing/pulling the release plate (58) so that the elongated opening (60) slides into the hold position. The actuator pin (38) is actuated by pulling a cord (94) attached to the release plate (46), optionally attached together by a biner clip (92), so that the elongated opening (60) moves into the release position thereby releasing the hammer (46) which strikes the head (42) of the actuator pin (38) resulting in the tip (40) of the actuator pin (38) being forcefully driven outward through the second end (34) of the actuator pin tube (26).

A preferred sighting mechanism (81) for determining position of the actuator pin (38) is a sight hole (80) in the body (14) and a visual indicator (82) disposed on the retention head (42) of the actuator pin (38) such that the visual indicator (82) is visible through the sight hole (80) when the actuator pin (38) is in proper position relative to a load cartridge (84), as shown in FIG. 1A. The visual indicator (82) may consist of a bright color such as green, orange or red. The barrel (18) further comprises a pinched region (83) adjacent the fitted opening (30) for preventing the actuator pin tube (26) from sliding into the body (14) during use. The retention head (42) prevents the actuator pin (38) from being ejected out of the actuator pin tube (26) or through the pinched region (83) where provided.

Figure 3A:
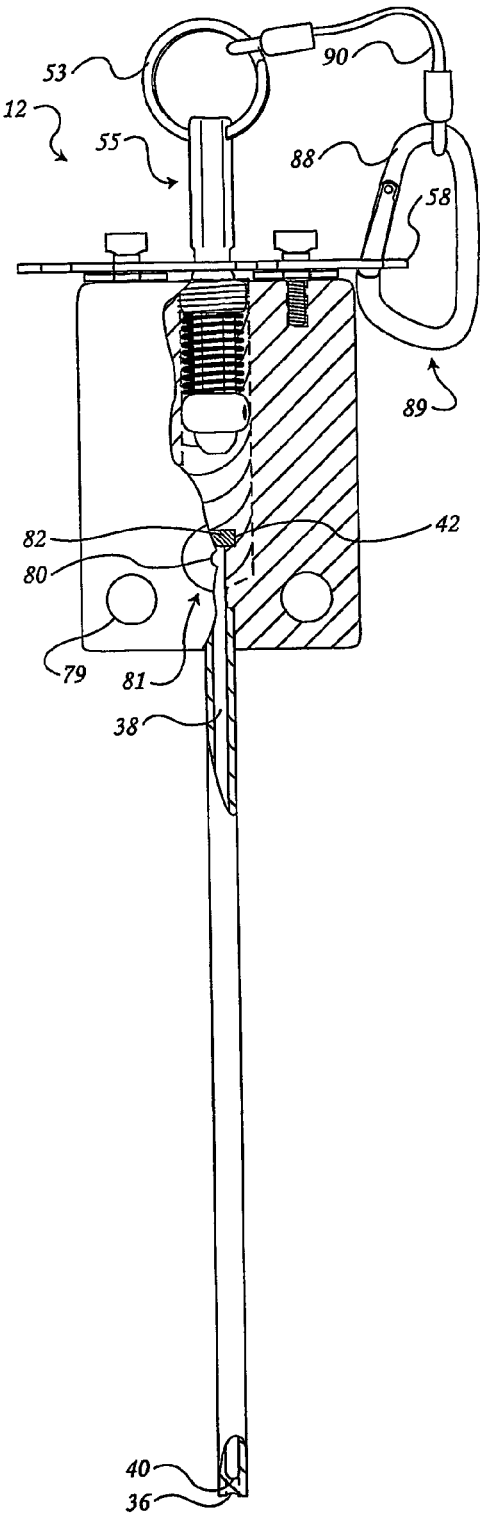
FIG. 3A is a sectional side view of the upper portion of the tool according to the present invention depicting the tool in an armed position with safety engaged.
Figure 3B:
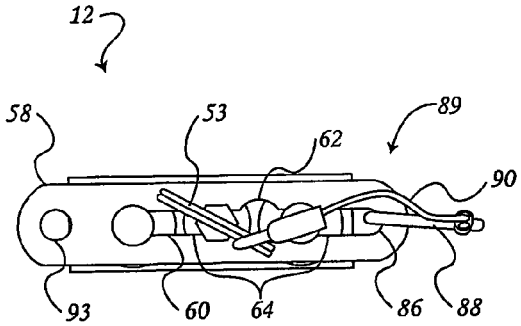
FIG. 3B is a top view of the tool of FIG. 3B is an armed position with the safety engaged.

The safety mechanism (89) is preferably disposed on the release mechanism (56). A preferred safety mechanism (89) consists of an extension (86) of the elongated opening (60) of the release plate (58) for slidably receiving a safety clip (88) therethrough. The safety clip (88) may be a biner clip having a spring load closure, as is well known. FIGS. 3A and 3B show the tool cocked and having the safety clip (88) engaged in the extension (86) of the elongated opening (60) thereby preventing premature firing of the tool (12). The safety clip (88) may be disposed on the pull string (94), which may be attached to the ring-handle (53) or equivalent handle mechanism (55), for convenience. The safety clip (88) is not limited to a biner clip as shown in the drawings but may be any comparable device, such as a bent pin or the like which can removably accommodate the extension (86) and prevent the release plate (58) from sliding from the hold position to the release position. A closed safety clip (88) as shown, or an analogous clip, is preferred as it prevents the accidental removal of the safety clip (88) from the extension (86).

Two anchor openings (79) designed to accommodate anchor cords, such as bungee cords (not shown), are disposed through the body (14). The two anchor openings (79) are disposed substantially perpendicular to the barrel (18), and adjacent to the fitted opening (30), for applying restraining forces upon the tool (12) preventing the tool's (12) dislodgement from a borehole (B) during detonation of load cartridge (84). In a preferred embodiment, the anchor openings (79) may be ⅜-inch openings.

Figure 5:
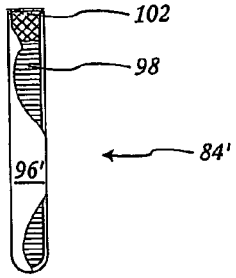
FIG. 5 is a sectional view of another embodiment of the cartridge utilized in accordance with the present invention.

A first embodiment of the cartridge (84), used with the present invention, is shown in a cutaway borehole (B) of FIG. 1. The first embodiment of the cartridge (84) has a tubular shaped casing (96) having a bottom which may be a plug (100), at one end and a primer (102) at the opposing end. The propellant or load (98) is disposed within the casing (96) between the bottom (100) and the primer (102). A second embodiment of the cartridge (84') is shown in FIG. 5. The second embodiment of the load cartridge (84') has a test tube shaped casing (96') with a primer (102) at the open end. The propellant (98) is disposed within the casing (96'), as shown in FIG. 5. The present invention is not limited to the use of the cartridges (84 and 84') shown but encompasses all possible embodiments of a scale-to-tool fit load cartridge, which can be detonated by a force on the primer through an actuator pin (38) and hammer (46) according to the present invention. The primer (102) may be comprised of a conventional 209 shotshell primer. The propellant (98) may consist of smokeless powder or other suitable propellant. The tubing may consist of a 5/16-inch (outer diameter) plastic tubing with the tube being 2¼-inches long. The plug (100) may be comprised of hot glue applied using hot glue technology.

Figure 1B:
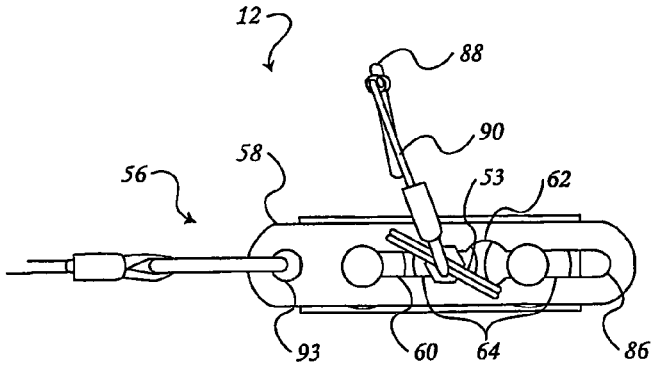
FIG. 1B is a top view of the tool of FIG. 1A wherein the tool is in the armed position without the safety engaged.

FIGS. 1A and 1B are two views of the tool (12) in a cocked arrangement without a safety engaged. The cocked arrangement is referred to as the hold position, and is also shown in FIGS. 3A and 3B. FIG. 1A shows the tool (12) as used in a borehole (B) of a rock (R) with a load cartridge (84) inserted in the bottom of the borehole (B). The tool (12) of FIGS. 1A and 1B is ready for the pull cord (94) to be pulled. When the pull cord (94) is pulled, the release plate (58) moves to the release position, shown in FIGS. 2A and 2B, and the hammer (46) is released resulting in the hammerhead (50) striking the retention head (42) which results in the tip (40) of the actuator pin (38) striking the primer (102) of the cartridge (84) thereby detonating the propellant (98) and generating a sudden increase of pressure in the borehole (B) resulting in the breaking of the rock (R).

Figure 6:
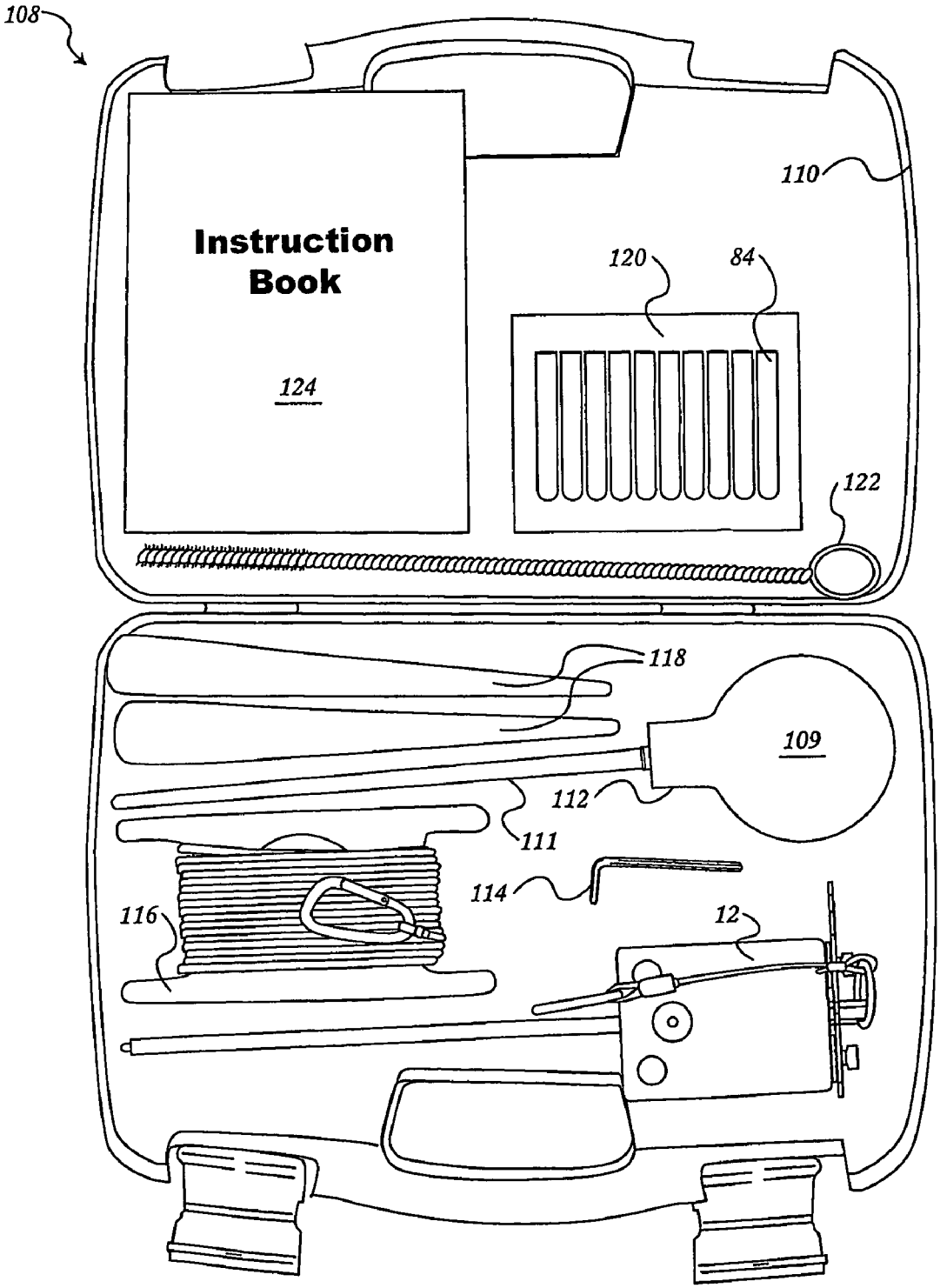
FIG. 6 is a top view of a kit containing the tool according to the present invention.

The tool (12) of the present invention may be provided in a kit (108), as shown in FIG. 6. The kit (108) contains the tool (12) for breaking rock (R), a rubber bulb hole blower (112), a cord keeper (116) with the release cord (94) and clip (92) disposed on it, two tapered drift pins (118), a hex key (114), a borehole cleaning brush (122) and an instruction manual (124). A package (120) containing cartridges (84) may be provided separately from the kit (108) or with it. The release cord (94) is preferably at least 25 feet (eight meters) long for safety. The package (120) shown contains ten load cartridges (84). The rubber bulb blower (112) has a hole blower tube (111) and a bulb (109). The bulb (109) may consist of a four-ounce rubber bulb having a diameter of about 2½-inches. The blower tube (111) is about 9½-inches long, and has an external diameter of ¼-inch and an internal diameter of 3/16-inches. The cleaning brush (122) may have an over all length of about 12 inches with a 2⅝-inch long brush with a diameter of 5/16-inch. The cleaning brush (122) may be a 0.30 caliber pistol cleaning tool, as is well known. The cord keeper (116) may be any suitable keeper; however, a flat metal or other rigid material frame is suitable. The release cord (94) may be a ⅛ inch diameter nylon or polyester cord, such as a lawnmower pull cord and may be tied to a biner clip (92) with a double half hitch knot or the like. The two tapered drift pins (118) may be 8 inches long with a ¼-inch diameter on the narrow end and a 1-inch diameter on the larger end. The hex key (114) may be a ⅛-inch hex Allen (trademark) wrench.

Obviously, all of the dimensions expressed herein must be adjusted to the actual relative size of the tool (12) used. The present invention is not limited to the exact size and dimensions of the alternative embodiments of the tool (12) or kit (108) as described herein.

The operation of the tool (12) for breaking rock (R) according to the present invention involves numerous steps. The operation of the tool (12) shall be described using the dimensions of a preferred embodiment of the tool (12) as disclosed herein for example purposes only. Initially, a borehole (B) must be drilled in the rock (R) or other hard material to be cracked. The borehole (B) diameter should be about 5/16 of an inch for a preferred embodiment. In any case, the borehole shall allow sufficient space to insert the actuator pin tube (26) while being restrictive enough to prevent rapid escape of gasses following detonation of the cartridge (84). The borehole (B) should be no deeper then the length of the actuator pin tube (26) plus the cartridge (84). Marking the drill bit at the proper length from the end will greatly aid in drilling holes to the proper depth. The use of a new and sharp carbide masonry bit is highly recommended. Worn bits can drill undersized boreholes, which will not allow the tool's (12) actuator pin tube (26) to be inserted into the borehole (B) to its full depth. If problems are experienced with the boreholes being too small or two large, measurement of the bits used may determine the cause. Also, boreholes (B) that are not drilled straight can cause problems in the step of inserting the actuator pin tube (26) into the borehole (B) to the full depth.

Inserting the actuator pin tube (26) into the borehole (B) to its full depth or until it males contact with the primer (102) is desirable for proper operation of the tool (12). If the borehole (B) is not able to accommodate the actuator pin tube (26) appropriately allowing the tip (40) to make contact with the primer (102) of the cartridge (84), no ignition of the cartridge (84) will occur. Depending on the hardness and type of material the borehole (B) should be 4 to 12 inches from the edge of the material you intend to crack. Experimentation will aid in determining the proper placement of the tool (12) in a given type of material. Drilling in the center of a large rock may not be effective and may only eject the tool (12) from the borehole (B) upon ignition of the cartridge (84) without breaking the rock. If this occurs, drilling closer to the edge of the rock will yield better results.

The borehole (B) is then cleaned of all debris and rock dust generated during the drilling process. Use the rubber bulb hole blower (112) included in the kit (108) to blow out the dust and debris. Any other technique, which uses forced air such as air compressor, will also be effective as long as the tube delivering the air is of sufficient length to reach the bottom of the borehole (B) and eject all loose material.

Next verify that the actuator pin tube (26) of the tool (12) can be inserted to the full depth of the borehole (B). A snug fit is best because it will hold the tool (12) in place upon ignition of the cartridge (84). If the borehole (B) is too tight, running the rotating drill bit in and out of the borehole (B) can dislodge packed rock dust that the hole blower (112) did not remove. The problem will not be resolved if the drill bit is undersized or the hole is not drilled straight. The diameter of the drill bit should be checked if cleaning the borehole (B) does not cure the problem. After running the rotating drill bit in and out of the borehole (B), blow out the borehole (B) again and make sure that the actuator pin tube (26) of the rock-breaking tool (12) can be inserted to the full intended depth of the borehole (B). It is important to verify that the actuator pin tube (26) can fit fully in the borehole (B) prior to inserting the cartridge (84).

The next step is to insert the cartridge (84) into the cleaned and verified borehole (B) making sure that the end of the cartridge (84) with the metal primer (102) is positioned correctly so that it will make contact with the tip (40) of the tool (12) when the tool is inserted into the borehole. Using the hole blower tube (111) gently push the cartridge to the bottom of the borehole. Very little or no force should be required as the outside diameter of the cartridge (84) is slightly smaller than that of the actuator pin tube (26).

The release cord (94) should be connected to the release mechanism (56), stretched out to its full length of 25 feet (8 meters), and attached to the release hole (93). The release opening (93) is ¼-inch wide and is a ¼-inch from the closest edge with the elongated opening (60) being a ¼ inches from the opposing edge. The rock-breaking tool (12) is then cocked by pulling on the handle mechanism (55), such as the split ring handle (53), and pushing the release plate (58) into the hold position as shown in FIGS. 1A and 1B. The safety clip then needs to be engaged in the extension of the opening in the release plate (58) so as to prevent premature release of the hammer (46) and detonation of the cartridge (84). Cocking of the tool (12) is accomplished by pulling the handle mechanism (55) away from the body (14) of the tool (12) while pushing the release plate (58) into the hold position until the retention groove (66) of the hammer (46) is engaged in the narrow portion (64) of the elongated opening (60) of the release plate (58).

The tool (12) should then be shaken, preferably using a whipping motion, to force the actuator pin (38) to extend from the tip (40) of the actuator pin tube (26). If the actuator pin (38) is not easily shifted, the tool (12) should be checked for damage or dirt that may inhibit its free movement. The rock-breaking tool (12) should never be used if the actuator pin (38) does not move freely. The visual indicator (82) should not be seen through the sight hole (80) when the actuator pin (38) is in the proper extended position. With the actuator pin (38) extended, carefully insert the actuator pin tube (26) into the borehole (B) and gently slide in until the tip (40) of the actuator pin (38) makes contact with the cartridge (84) previously inserted in the borehole (B), as shown in FIG. 1A.

Some resistance to insertion of the actuator pin tube (26) is desirable as this will contribute to the effectiveness of the tool (12) in that the gasses produced from ignition of the load cartridge (84) will not easily eject the tool (12) from the borehole (B). To make sure the contact with the cartridge (84) is properly made, the visual indicator (82) should be visible though the sight hole (80). If the indicator (82) cannot be seen, the tip (40) of the actuator pin (38) is probably not in contact with the primer (102) of the load cartridge (84). If the tip is not in contact with the primer (102) of the cartridge (84) and ready to fire, the tool (12) will not initiate the cartridge (84). Covering the masonry or rock with a blast mat, such as an old carpet or other heavy material, is recommended and will avoid damage to anything in the immediate area from fly rock.

After making sure that the area is clear, unengage the safety mechanism (89) by removing the safety clip (88) and retreat to the end of the release cord (94). Be extremely careful to avoid stepping on or tripping over the release cord (94) and accidentally setting off the tool (12) as you retreat to the end of the cord (94). Before initiating the cartridge (84) carefully scan the area around where the work is being performed to make sure that no one has inadvertently entered the work area. When the area is clear pull the release cord (94) firmly until the tool (12) ignites the cartridge (84).

Routine disassembly, cleaning and lubrication with a light oil will keep the tool (12) fully functional. Special attention should be paid to maintain free movement of the actuator pin (38) that extends from the actuator pin tube (38). Free movement of the actuator pin (38) should always be checked before each use. The conditions that might inhibit this free movement of the actuator pin (38) should be remedied before using the tool (12).

When breaking masonry in a hole or a ditch the pulling action of the release cord (94) may tend to lift the tool (12) out of position. If this happens, the actuator pin (38) will not be able to make proper contact with the primer (102) and will not detonate the load (98). To solve this problem, the release cord (94) should be redirected so that the pulling action does not lift the tool (12) out of the borehole (B) when the releases cord (94) is pulled. A weight with a small pulley (not shown) positioned below the level of the release plate (58) with the release cord (94) passed through the pulley may solve the problem mentioned above. Alternatively, drilling a shallow second borehole adjacent the borehole in which an anchor/pulley assembly is installed can also provide the required redirect of the release cord (94).

When breaking rock in situations where gravity does not hold the tool (12) in place. The use of additional boreholes to mount anchors to hold the tool by means of bungee cords and the like may be used. In this situation, the bungee cords or other anchors are threaded through the anchor openings (79) in the tool (12) body (14).

As a matter of caution, it is desirable for the user to practice using the tool (12) before undertaking important demolition or rescue operations. Because of the very low energy cartridges (84) used according to the present invention, special attention must be paid to such subtleties as the grain of the material and the distance from a free edge. If the material is flawed, cracked, contains voids or is especially soft, the present invention may not be appropriate and may fail because the breaking action is dependant on the very rapid buildup of pressure upon activation of the cartridge (84). If the gasses discharged from a detonated cartridge (84) are released too rapidly through cracks, holes and the like in the rock, then sufficient force to crack the rock will not be generated. In situations where the material is flawed or cracked, an alternative technique may prove more effective. Placement of cartridges (84) too near the bottom of a rock may also prove ineffective because the rock may only blow out at the bottom. If possible, placing the cartridge (84) near the middle of the mass to be broken may avoid these difficulties and gain maximum effect. It is also desirable for the user to always use eye, ear and hand protection when employing the method of the present invention. Furthermore, the present invention should never be operated with anyone, including the user, within 25 feet (8 meters) of the tool (12).

It is to be understood that the present invention is not limited to the embodiments described above, but encompasses any and all embodiments within the scope of the following claims.

What is claimed is:

1. A tool (12) for breaking hard material, comprising:

a body (14) having an opening (16) therethrough forming a barrel (18), which receives a spring assembly (24) therein, the barrel (18) having a threaded opening (28) at a first end (20) of the barrel (18) and a fitted opening (30) at a second end (22) of the barrel (18);

an actuator pin tube (26) having a first and a second end (32 and 34), and an opening (36) therethrough for slidably engaging an actuator pin (38), wherein the first end (32) of the actuator pin tube (26) is engaged securely in the fitted opening (30), and the second end (34) of the actuator pin tube (26) extends from the fitted opening (30);

the actuator pin (38) having a tip (40) and a retention head (42) at opposing ends (41 and 43) of the actuator pin (38), wherein the retention head (42) is wider than the opening (36) in the actuator pin tube (26), and the actuator pin (38) is longer than the actuator pin tube (26) permitting the tip (40) to extend through the second end (34) of the actuator pin tube (26);

the spring assembly (24) comprises a hammer guide (44) engaged in the threaded opening (28), a hammer (46) slidably engaged through the hammer guide (44), a handle mechanism (55) for manually cocking the hammer (53) disposed on a first end of the hammer (46), a spring retainer (52) disposed adjacent a second end (50) of the hammer (46), and a spring (54) engaged on the hammer (46) between the spring retainer (52) and the hammer guide (44), wherein the second end (50) of the hammer (46) is formed into a hammerhead (51), and the hammerhead (51) is extended towards the retention head (42) when the spring (54) is fully relaxed; and a release mechanism (56) for releasably engaging the hammer (46).

2. The tool of claim 1 further comprising:

a safety mechanism (89) for preventing premature release of the hammer (46) when the hammer (46) is engaged in the release mechanism (56).

3. The tool of claim 2 wherein:

the safety mechanism (89), when engaged, is disposed on the release mechanism (56).

4. The tool of claim 1, further comprising:

a sighting mechanism (81) for visually determining whether the actuator pin (38) is properly positioned.

5. The tool of claim 4, wherein:

the sighting mechanism (81) comprises a sight hole (80) in the body (14) and a visual indicator (82) disposed on the retention head (42) of the actuator pin (38), wherein the visual indicator (82) is visible through the sight hole (80) when the actuator pin (38) is in proper position relative to a load cartridge (84).

6. The tool of claim 1, wherein:

the release mechanism (56) comprises a release plate (58) slidably engaged on the body (14) adjacent the first end (20) of the barrel (18) and having the hammer (46) slidably engaged in an elongated opening (60) of the release plate (58) wherein the elongated opening (60) has a wide portion (62) and a narrow portion (64), and the hammer (46) has a retention groove (66) disposed between the first and second ends (48 and 50) of the hammer (46) such that the hammer (46) can freely slide when the wide portion (62) is engaged on the hammer (46) but is retained in position when the retention groove (66) is engaged in the narrow portion (64) of the elongated opening (60), and a release opening (93) for receiving a pull cord (94) is disposed in the release plate adjacent the wide portion (62) and opposite the narrow portion (64) such that force applied to the pull cord (94) pulls the release plate (58) to release the hammer (46).

7. The tool of claim 6, wherein:

the release plate (58) is slidably engaged on first and second release plate screws (68 and 70) each having a collar (69) and a threaded portion (67) wherein the release plate screws (68 and 70) and the body (14) are further separated by first and second washers (72 and 74) and the release plate screws (68 and 70) are fixedly engaged in threaded openings (76 and 78) of the tool body (14) wherein the threaded openings (76 and 78) of the tool body (14) are flanking the threaded opening (28) of the barrel (18).

8. The tool of claim 6, further comprising:

a safety mechanism (89), wherein the safety mechanism (89) is an extension (86) of the elongated opening (60) for slidably receiving a safety clip (88) therethrough.

9. The tool of claim 8, wherein:

the safety clip (88) is attached to the handle mechanism (55) via a cord (90).

10. The tool of claim 1, wherein:

the barrel (18) further comprises a pinched region (83) adjacent actuator pin tube (16) from sliding into the body (14).

11. The tool of claim 1, wherein:

the handle mechanism (55) for manually cocking the hammer (46) is engaged in an opening (106) through the first end (48) of the hammer (46).

12. The tool of claim 1, further comprising:

anchor openings (79) disposed through the body (14), substantially perpendicular to the barrel (18), and adjacent to the fitted opening (30), for applying restraining forces therethrough preventing the tool's (12) dislodgement during-handle detonation of a load cartridge (84).

13. A kit comprising:

A tool (12) for breaking rock, a rubber bulb hole blower (112), a cord keeper (116) with a release cord (94) and a clip (92) disposed on the release cord (94), a package (120) containing load cartridges (84), and an instruction manual (124);

wherein the tool (12) comprises a body (14) having an opening (16) therethrough forming a barrel (18), which receives a spring assembly (24) therein, the barrel (18) having a threaded opening (28) at a first end (20) of the barrel (18) and a fitted opening (30) at a second end (22) of the barrel (18);

an actuator pin tube (26) having a first and a second end (32 and 34), and an opening (36) therethrough for slidably engaging an actuator pin (38), wherein the first end (32) of the actuator pin tube (26) is engaged securely in the fitted opening (30), and the second end (34) of the actuator pin tube (26) extends from the fitted opening (30);

the actuator pin (38) having a tip (40) and a retention head (42) at opposing ends (41 and 43) of the actuator pin (38), wherein the retention head (42) is wider than the opening (36) in the actuator pin tube (26), and the actuator pin (38) is longer than the actuator pin tube (26) permitting the tip (40) to extend through the second end (34) of the actuator pin tube (26);

the spring assembly (24) comprises a hammer guide (44) engaged in the threaded opening (28), a hammer (46) slidably engaged through the hammer guide (44), a handle mechanism (55) for manually cocking the hammer (53) disposed on a first end of the hammer (46), a spring retainer (52) disposed adjacent a second end (50) of the hammer (46), and a spring (54) engaged on the hammer (46) between the spring retainer (52) and the hammer guide (44), wherein the second end (50) of the hammer (46) is formed into a hammerhead (51), and the hammerhead (51) is extended towards the retention head (42) when the spring (54) is fully relaxed; and a release mechanism (56) for releasably engaging the hammer (46).

14. The kit according to claim 13, wherein:

the release cord (94) is preferably at least 25 feet long.

15. The kit according to claim 13, further comprising:

two tapered drift pins (118), a hex key (114), and a borehole cleaning brush (122).

16. A method for breaking hard material, comprising the steps of:

a. providing a tool (12) for breaking hard material, wherein the tool (12)

i. comprises a body (14) having an opening (16) therethrough forming a barrel (18), which receives a spring assembly (24) therein, the barrel (18) having a threaded opening (28) at a first end (20) of the barrel (18) and a fitted opening (30) at a second end (22) of the barrel (18);

ii. an actuator pin tube (26) having a first and a second end (32 and 34), and an opening (36) therethrough for slidably engaging an actuator pin (38), wherein the first end (32) of the actuator pin tube (26) is engaged securely in the fitted opening (30), and the second end (34) of the actuator pin tube (26) extends from the fitted opening (30);

iii. the actuator pin (38) having a tip (40) and a retention head (42) at opposing ends (41 and 43) of the actuator pin (38), wherein the retention head (42) is wider than the opening (36) in the actuator pin tube (26), and the actuator pin (38) is longer than the actuator pin tube (26) permitting the tip (40) to extend through the second end (34) of the actuator pin tube (26);

iv. the spring assembly (24) comprises a hammer guide (44) engaged in the threaded opening (30), a hammer (46) slidably engaged through the hammer guide (44), a handle mechanism (55) for manually cocking the hammer (53) disposed on a first end of the hammer (46), a spring retainer (52) disposed adjacent a second end (50) of the hammer (46), and a spring (54) engaged on the hammer (46) between the spring retainer (52) and the hammer guide (44), wherein the second end (50) of the hammer (46) is formed into a hammerhead (51), and the hammerhead (51) is extended towards the retention head (42) when the spring (54) is fully relaxed; and v. a release mechanism (56) for releasably engaging the hammer (46) by pulling a pull cord (94) engaged on the release mechanism (56);

b. providing a cartridge (84) having a tubular shaped casing (96) with a closed bottom (100) at one end and a primer (102) at the opposing end and a load (98) interspersed therebetween the bottom (100) and the primer (102);

c. drilling a borehole (B) in a hard material (R) wherein the borehole (B) will accommodate the full length of the actuator pin tube (26) which extends from the fitted opening (30) of the barrel (18);

d. cleaning out the borehole;

e. inserting the load cartridge (84) all the way into the borehole (B) so the primer (102) will come into contact with the tip (40) of the actuator pin (38) once the actuator pin tube (26) is engaged in the borehole (B);

f. shaking the actuator pin (38) into position so that the tip (40) extends from the second end (34) of the actuator pin tube (26);

g. inserting the actuator pin tube (26) into the borehole (B) such that the tip of the actuator pin (38) meets the primer (102) of the load cartridge (84);

h. connecting the pull cord (96) to the handle mechanism (55);

i. extending the pull cord (96) to its full length; and j. pulling the pull cord (96) to detonate the load cartridge (84).

17. The method according to claim 16, further comprising:

a. engaging a safety mechanism (89) to prevent premature release of the hammer (46); and b. disengaging the safety mechanism (89).

18. The method according to claim 16, further comprising:

a. anchoring the tool (12) to the hard material adjacent the borehole (B) to prevent the premature disengagement of the tool (12) from the borehole (B), wherein the tool (12) further comprises anchor openings (79) disposed through the body (14), substantially perpendicular to the barrel (18), and adjacent to the fitted opening (30), for applying restraining forces therethrough preventing the tool's (12) dislodgement during-handle detonation of a load cartridge (84).

19. The method according to claim 16, further comprising:

a. verifying that the actuator pin (38) is appropriately positioned relative to the hammerhead (51) and the primer (102) of the load cartridge (84), wherein the tool (12) further comprises a sighting mechanism (81) for visually determining whether the actuator pin (38) is properly positioned.

20. The method according to claim 16, wherein:

the release mechanism (56) comprises a release plate (58) slidably engaged on the body (14) adjacent the first end (20) of the barrel (18) and having the hammer (46) slidably engaged in an elongated opening (60) of the release plate (58) wherein the elongated opening (60) has a wide portion (62) and a narrow portion (64), and the hammer (46) has a retention groove (66) disposed between the first and second ends (48 and 50) of the hammer (46) such that the hammer (46) can freely slide when the wide portion (62) is engaged on the hammer (46) but is retained in position when the retention groove (66) is engaged in the narrow portion (64) of the elongated opening (60), and a release opening (93) for receiving a pull cord (94) is disposed in the release plate adjacent the wide portion (62) and opposite the narrow portion (64) such that force applied to the pull cord (94) pulls the release plate (58) to release the hammer (46).

* * * * *